US006135476A

United States Patent [19]

Dickie et al.

[11] Patent Number: 6,135,476

[45] Date of Patent: Oct. 24, 2000

[54] WHEELCHAIR SEAT SUPPORT BRACKET

[75] Inventors: Paul C. Dickie, Clovis, Calif.; Darin J. Trippensee, Boulder, Colo.

[73] Assignee: Sunrise Medical HHG Inc., Longmont, Colo.

[21] Appl. No.: 09/191,983

[22] Filed: Nov. 13, 1998

[51] Int. Cl.[7] ..... A61G 5/10

[52] U.S. Cl. ..... 280/250.1; 280/304.1; 297/313; 297/327; 403/84

[58] Field of Search ..... 280/250.1, 304.1; 297/313, 327; 403/83, 85, 93, 359.1, 84, 86

[56] References Cited

U.S. PATENT DOCUMENTS

| | | | |
|---|---|---|---|
| D. 361,258 | 8/1995 | Helman | D8/354 |
| 3,601,424 | 8/1971 | Badland | 280/124 |
| 3,881,773 | 5/1975 | Rodaway | 280/250.1 |
| 4,779,885 | 10/1988 | Zinn | 280/304.1 |
| 4,892,354 | 1/1990 | Estkowski et al. | 297/313 |
| 5,154,438 | 10/1992 | Barclay | 280/250.1 |
| 5,364,165 | 11/1994 | Okamoto | 280/304.1 |
| 5,409,247 | 4/1995 | Robertson et al. | 280/250.1 |
| 5,520,474 | 5/1996 | Liu | 403/84 |
| 5,727,809 | 3/1998 | Ordelman et al. | 280/250.1 |
| 5,765,958 | 6/1998 | Lan | 403/84 |
| 5,848,658 | 12/1998 | Pulver | 180/65.1 |
| 5,871,227 | 2/1999 | Huang | 403/93 |
| 5,997,021 | 12/1999 | Robinson et al. | 280/250.1 |
| 6,032,976 | 3/2000 | Dickie et al. | 280/250.1 |

OTHER PUBLICATIONS

BF Goodrich Inc., Torsionelastic Spring Product Brochure, 1986.

BF Goodrich Company, Torsilastic Spring Sales Brochure.

*Primary Examiner*—Lanna Mai

*Assistant Examiner*—Ruth Ilan

*Attorney, Agent, or Firm*—MacMillan, Sobanski & Todd, LLC

[57] ABSTRACT

A support bracket for supporting a wheelchair seat frame relative to a wheelchair base frame includes a first end having a socket therein and a second end that is structured and configured to couple to a lateral rod which is connected to the seat frame. The socket is dimensioned and configured to receive an element which, in turn, is provided with a passage for receiving a lateral strut. The lateral strut is fixed relative to the wheelchair frame and is positionable in a substantially fixed position relative to the element in the socket in the first end of the support bracket.

18 Claims, 5 Drawing Sheets

WHEELCHAIR SEAT SUPPORT BRACKET

TECHNICAL FIELD

This invention relates in general to wheelchairs. More particularly, this invention relates to a wheelchair seat support bracket. Most particularly, the invention relates to a support bracket having a resilient element, and for coupling a wheelchair seat base to the wheelchair base frame.

BACKGROUND OF THE INVENTION

Wheelchairs are well known forms of transportation that increase the mobility of the physically impaired. Wheelchairs are typically relatively small, single-person conveyances that generally comprise a seat base supported by a base frame which, in turn, is supported by two oppositely disposed rear drive wheels and front casters. The drive wheels are usually located behind the center of gravity of the wheelchair occupant and the front casters are swivel-mounted to the wheelchair frame to permit the occupant to maneuver the wheelchair with greater ease. The wheelchair is maneuvered by differentially driving the drive wheels.

Wheelchair occupants who have substantially no control over their lower extremities are prone to pressure sores as a result of having to remain in a fixed position for prolonged periods of time. Pressure sores are especially prominent in the pelvis region of the wheelchair occupant because the bones in the pelvis area are relatively sharp and prolonged pressure against the wheelchair occupant's skin may cause trauma to the skin tissue. Hence, it is important to reduce the number of pressure points against the wheelchair occupant's body. For at least this reason, pressure relieving wheelchair seats have been devised.

Wheelchairs generally comprise a seat sling supported by the seat base. The seat sling supports a seat cushion formed from a foam material and covered with a fabric covering. However, even foam material, such as foam rubber, has limited pressure-relieving characteristics. Hence, more recent innovations in technology have led to the development of gel cushions. Gel cushions are often used in conjunction with a foam seat cushion. Gel cushions typically comprise a membrane containing a relatively high viscosity gel. The advantage of gel cushions is that gel moves when pressure is applied to reduce the number of pressure points.

In addition to constant pressure points, sudden or abrupt shock or jolts to the wheelchair occupant may also cause tissue trauma. Minor abrupt changes in the pelvis area due to sudden jarring may cause injury to the wheelchair occupant's tissue. Beyond injury to the tissue, shock encountered by a wheelchair traversing rough terrain may also be transmitted through the wheelchair to the wheelchair occupant's spine, subjecting the upper torso of the wheelchair occupant to injury. Gel cushions have a limited effect on absorbing shock.

To reduce the risk of injury resultant from shock, wheelchairs have been equipped with shock absorbers. Shock absorbers are typically provided to absorb shock between the drive wheels and the base frame. The shock absorbers are typically of the mechanical type, embodying mechanically moving parts that require a dampening mechanism. The dampening mechanism is commonly of the hydraulic type, which requires an oil reservoir. Mechanical shocks are relatively heavy. Moreover, mechanical shocks can be costly, and this cost is often passed onto the wheelchair occupant, who is generally economically disadvantaged. A need exists for a lightweight, low-cost shock absorbing mechanism that employs few moving parts and that dampens shocks without the need for an oil reservoir to provide a relatively soft or smooth ride for the wheelchair occupant without bottoming out.

Often, even under the most ideal conditions, the softest cushions and most effective shock absorbers alone may not be affective in an assault against pressure sores. A completely static condition often results in muscle atrophy, which further contributes to tissue trauma or skin breakdown. To further reduce the risk of tissue trauma, it is desirable to frequently shift or change the position of the wheelchair occupant in the wheelchair. It is also desirable to change the position of the wheelchair occupant in accordance with the user's profile, or physical characteristics, or in accordance with various activities. Even able-bodied people normally shift and adjust their position according to various activities. A wheelchair occupant, however, is disadvantaged in that he or she is most frequently unable to orient his or her body in accordance with activities. A desired orientation of the wheelchair occupant is generally achieved by making appropriate adjustments to the wheelchair. Providing an element that offers resistance to shock and that permits variation in the wheelchair occupant's position may prove to be a cost effective alternative, or supplement, to the more conventional shock absorbers and adjustment elements.

In order to meet the needs of the physically impaired, wheelchairs must be versatile. Wheelchairs must be easily and readily adapted to accommodate the particular size and shape of the occupant. Wheelchairs must also be versatile in adapting to both ambulatory and recreational travel. Moreover, wheelchairs must be sufficiently durable to provide comfortable transportation over obstacles or irregular surfaces. A need exists for a shock-absorbing element that meets all these needs as well as the other needs set forth above.

SUMMARY OF THE INVENTION

This invention relates to a support bracket for supporting a wheelchair seat frame relative to a wheelchair base frame. The support bracket comprises a first end and a second end. A socket is provided in the first end. The second end is structured and configured to couple to a lateral rod which is connected to the seat frame. The socket is dimensioned and configured to receive an element which, in turn, is provided with a passage that is dimensioned and configured to receive a lateral strut. The lateral strut is fixed relative to the wheelchair frame and is positionable in a substantially fixed position relative to the element in the socket of in the first end of the support bracket.

DETAILED DESCRIPTION OF THE PREFERRED EMBODIMENT

Figure 1:
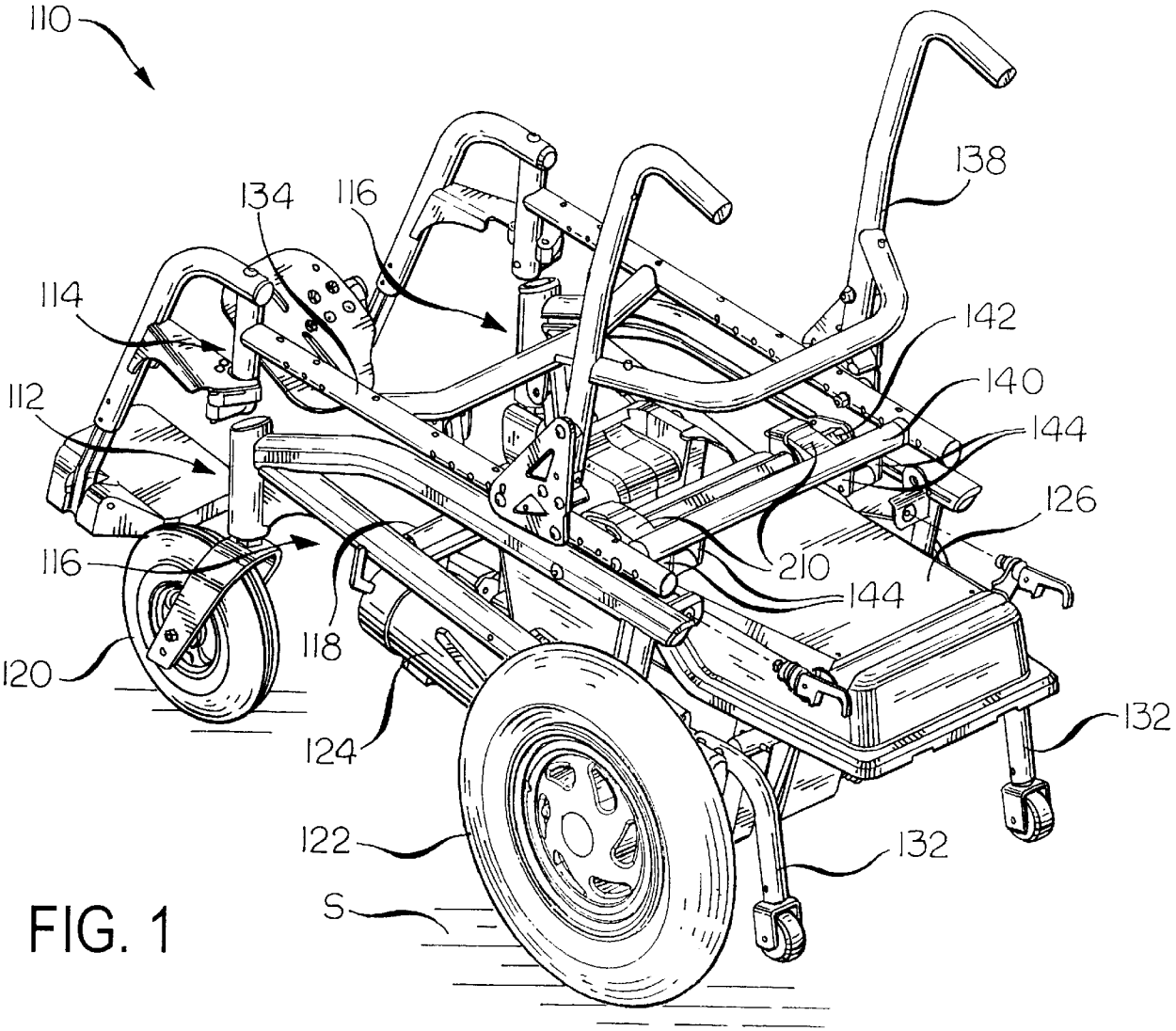
FIG. 1 is a partial front perspective view of a power wheelchair comprising a seat support bracket according to the invention.

Referring now to the drawings, there is illustrated in FIG. 1 a wheelchair 110 having a base frame 112 and a seat frame 114 supported by the base frame 112. The base frame 112 comprises spaced-apart side frames 116 joined together by struts 118. A pair of opposing front caster assemblies 120 and a pair of opposing rear drive wheels 122 vertically support the side frames 116 on a supporting surface S. The rear drive wheels 122 are differentially driven by opposingly disposed motors 124. The motors 124 are energized by a power source 126. An electronic control unit (not shown) and a joystick (not shown) control the operation of the motors 124. Anti-tip wheels 132 extending from the rear of the base frame 112 limit the rearward tip of the wheelchair 110 to reduce the risk of the wheelchair 110 tipping over rearwardly. A seat base 134 is supported by, and spans between, the side frames 116 so as to permit a wheelchair occupant (not shown) to be supported generally between the side frames 116. A seat cushion (not shown) is supported by the seat base 134 to provide improved comfort for the wheelchair occupant. A seat back frame 138 extends upward from a rear portion of the seat base 134 to support a seat back for the wheelchair occupant. A lateral rod 140 is coupled to the seat frame 114. A lateral strut 142 is coupled to, and spans between, the side frames 116. Laterally spaced apart pairs of tabs 144 extend radially, or perpendicularly, from the lateral rod 140. A pair of laterally spaced support brackets 210 couple the lateral rod 140 to the lateral strut 142. Each support bracket 210 is supported by the lateral strut 142 and coupled to a pair of laterally spaced apart tabs 144 of the lateral rod 140.

Figure 2:
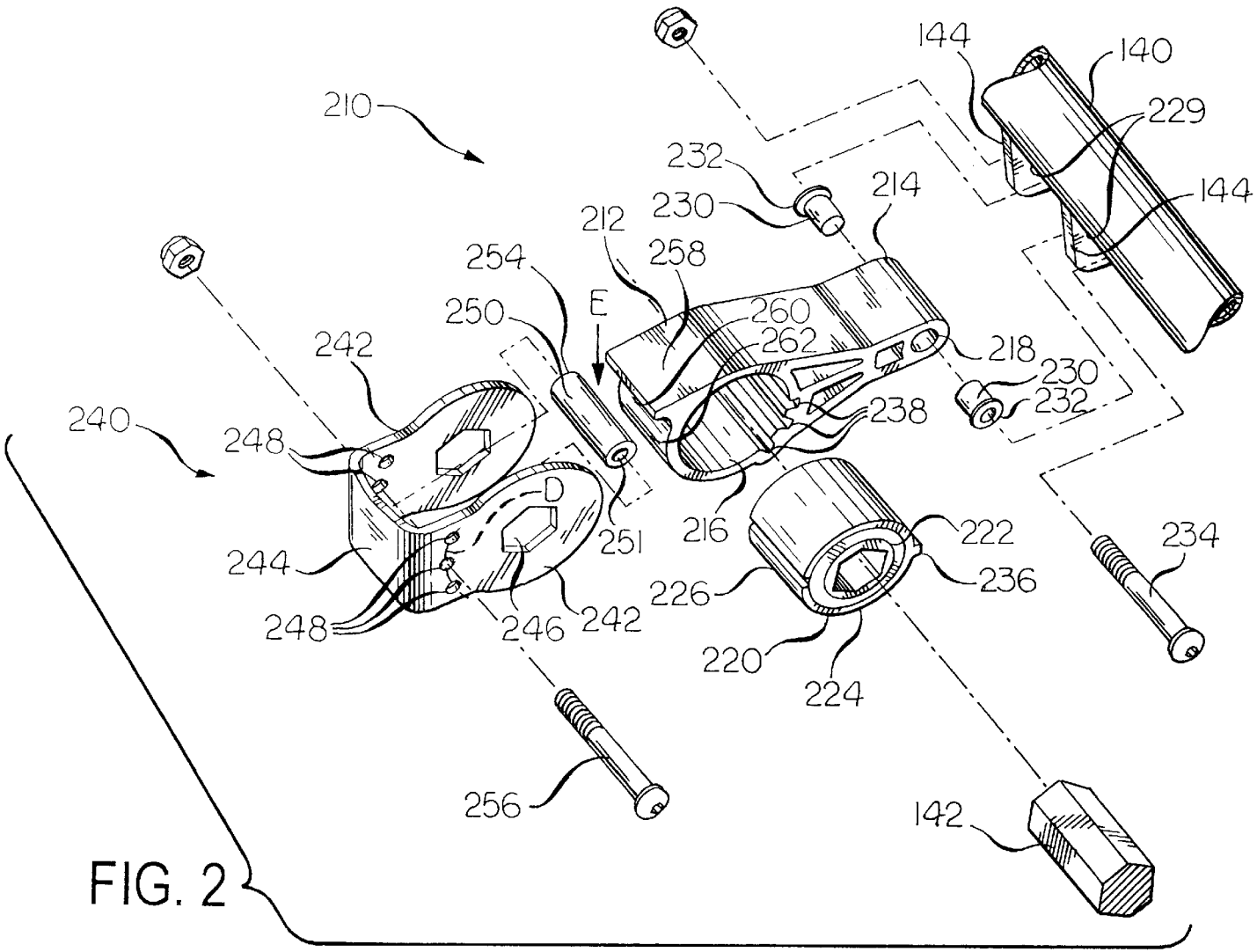
FIG. 2 is an exploded perspective view of the support bracket and a pre-load configuration.

As shown in FIG. 2, each support bracket 210 includes a first end 212 and a second end 214. A socket 216 is provided in the first end 212. A bore 218 is provided in the second end 214. The socket 216 is dimensioned and configured to receive a resilient element 220. The resilient element 220 is preferably an elastomeric material, such as rubber or vulcanized rubber. A spring commonly known as a TORSILASTIC® Spring manufactured by The BFGoodrich Company of Richfield, Ohio can be used for the resilient element. Different Torsilastic® Springs (e.g., Parts No. 32100, 32101, 32102) having different spring rates may be used to provide for wheelchair occupants of different weights, or on different supporting surfaces S. A passage 222 is provided in the resilient element 220. The passage 222 is dimensioned and configured to receive the lateral strut 142. The passage 222 and the lateral strut 142 are keyed so that the orientation of the resilient element 220 about the lateral strut 142 is positionable, and remains substantially fixed, relative to the lateral strut 142. That is to say, the lateral strut 142 remains substantially rotationally fixed relative to the lateral strut 142 so that the lateral strut 142 does not rotate relative to the resilient element 220.

As shown in FIG. 2, the resilient element 220 may be sandwiched between an inner sleeve 224 and an outer sleeve 226. The resilient element 220 may be compressed between the inner sleeve 224 and the outer sleeve 226 so as to engage frictionally the inner sleeve 224 and the outer sleeve 226. In this way, there is an increased likelihood that the position of the resilient element 220 relative to the inner sleeve 224 and the outer sleeve 226 will be maintained. The inner sleeve 224 may have a shape complementary to the shape of the passage 222 of the resilient element 220 to insure that the relative positions of the inner sleeve 224 and the resilient element are maintained. Moreover, the resilient element 220 may be bonded between the inner sleeve 224 and the outer sleeve 226 with a bonding component to cause the resilient element 220 to bond to the inner sleeve 224 and the outer sleeve 226.

It should be understood that, where an inner sleeve 224 is employed, the shape of the inner sleeve 224 corresponds to the shaped of the lateral strut 142 to prevent the lateral strut 142 from rotating relative to the inner sleeve 224. For example, the inner sleeve 224 shown is hexagonal in cross-sectional shape and the lateral strut 142 is likewise hexagonal in shape. Moreover, the inner sleeve 224 is dimensioned and configured to snugly receive the lateral strut 142 so that slop or play between the inner sleeve 224 and the lateral strut 142 is minimized.

It should also be understood that the outer sleeve 226 should be dimensioned and configured to snugly fit in the socket 216. As shown in the drawings, and particularly, in FIG. 2, the socket 216 is generally cylindrical in shape and the outer sleeve 226 is generally cylindrical in shape and dimensioned to fit snugly in the socket 216. Although a cylindrical shape is shown, other shapes can be used for carrying out the invention. That is to say, the socket 216 and outer sleeve 226 may have other shapes and the invention is not limited by the cylindrical shapes shown. This holds true for the inner sleeve 224 and the resilient element 220 as well.

As shown in FIG. 2, the tabs 144 extending from the lateral rod 140 each have a hole 229 passing therethrough. The holes 229 of each pair of tabs 144 co-align, or are arranged co-axially. The pairs of tabs 144 are spaced apart to receive the second end 214 of the support bracket 210 between the tabs 144. The bore 218 in the second end 214 of the support bracket 210 and the co-aligning holes 229 in the tabs 144 may be aligned to permit a pin 234 to be inserted through the co-aligning holes 229 and the bore 218. The pin 234 may be any element suitable to produce a pivot point or hinge arrangement. A pin (not shown) having a head at one end and a hole an opposite end for receiving a cotter pin may be used. The pin may have an annular groove (not shown) in the place of a hole for receiving a C-clip (also not shown). A carriage bolt and a nut (also not shown) may be employed for pivotally connecting the support bracket 210 to the tabs 144. These are merely examples of the pins that may be used to couple the support bracket 210 to the tabs 144. This pivot configuration is likewise provided for illustrative purposes. It should be understood that other pivot arrangements may be suitable for carrying out the invention.

Further illustrated in FIG. 2 are opposing sleeves 230. Each sleeve 230 is insertable into an opposite end of the bore 218 in the second end 214 of the support bracket 210 and carried by the pin 234. Each sleeve 230 may be provided with a flange 232 to limit the travel of the sleeve 230 into the bore 218. The sleeves 230 are preferably fabricated from a substantially durable, low friction material, such as nylon or a suitable metallic material. The sleeves 230 provide a bearing surface between the pin 234 and the bore 218, and the flanges 232 provide a bearing surface between the tabs 144 and the support bracket 210. It should be clearly understood that the bearing surfaces are provided to reduce the level of wear and tear on the tabs 144 and the support bracket 210.

As shown in FIG. 2, the outer sleeve 226 about the resilient element 220 may be provided with a key 236 that extends radially outward from the outer sleeve 226. The key 236 preferably extends the entire axial length of the outer sleeve 226. The socket 216 in the first end 212 of the support bracket 210 is provided with a plurality of radially extending notches 238 that also preferably extend the entire axial length of the socket 216. The notches 238 are dimensioned and configured to receive the key 236. Each notch 238 further preferably extends to at least one end or side of the socket 216 so as to permit the notches 238 to receive the key 236. The axial length of each notch 238 is further preferably equivalent to, or exceeds, the axial length of the key 236 to permit the key 236 to be completely inserted into the notch 238. It is most preferable that the notch 238 extends to the lateral extents of the socket 216. Each notch 238 represents an index point for adjusting the circumferential or relative position of the outer sleeve 226 within the socket 216. This indexing, in turn, adjusts the height of the lateral rod 140 relative to the height of the lateral strut 142. Since the lateral rod 140 supports the seat frame 114, the cooperative engagement of the key 236 with a selected notch 238 elevates the rear portion of the seat frame 114, and hence, the seat base 134, at a selective elevation. By engaging the key 236 with various notches 238, the height of the seat base 134 may be adjusted to various elevations.

Figure 3:
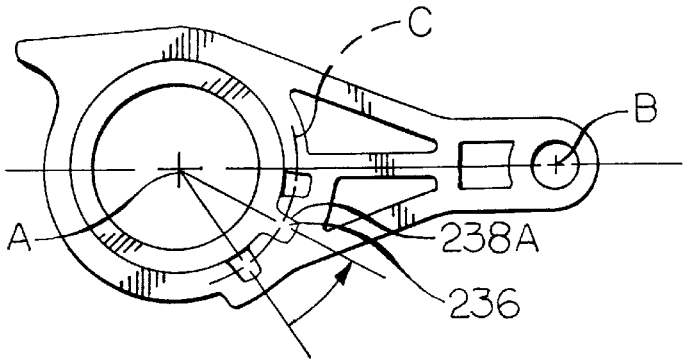
FIGS. 3 through 5 are diagrammatic representations in elevation of the support bracket at various levels of inclination.
Figure 4:
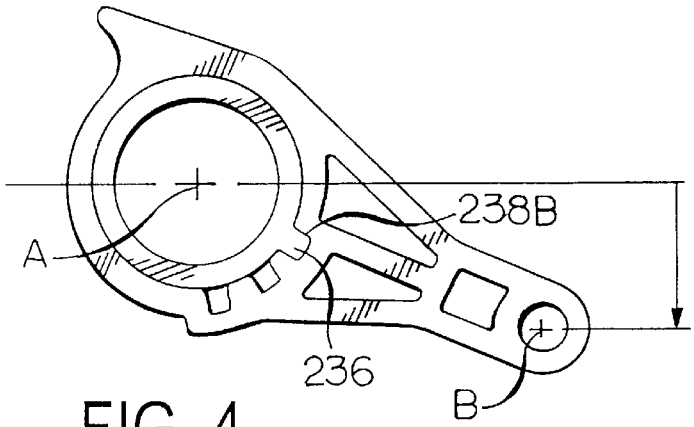
Figure 5:
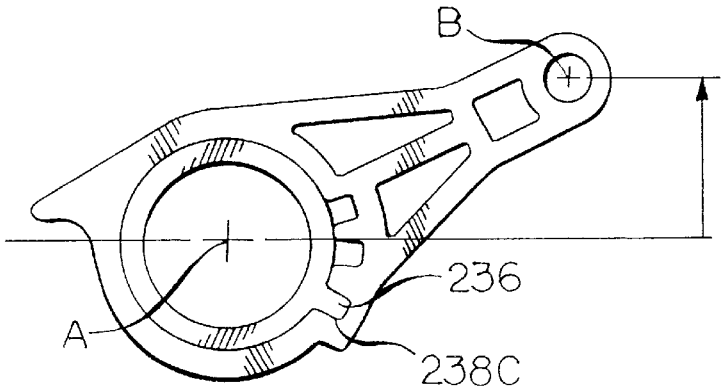

As illustrated in FIGS. 3 through 5, the notches 238 may be circumferentially spaced apart to permit substantially precise incremental changes in elevation of the lateral rod 140 among notches 238A, 238B and 238C. For example, as shown in FIG. 3, when the key 236 is engaged with the central notch 238A, the elevation of the lateral rod 140 is substantially equivalent to the elevation of the lateral strut 142. When the key 236 is engaged with the upper notch 238B, as shown in FIG. 4, the elevation of the lateral rod 140 is less than that of the lateral strut 142. Alternatively, the key 236 may be engaged with the lower notch 238C to displace the lateral rod 140 to an elevation greater than that of the lateral strut 142, as shown in FIG. 5. Substantially precise, vertical incremental adjustments in the lateral rod 140 relative to the lateral strut 142 may be provided. Such incremental adjustments are dependent on the physical characteristics of the support bracket 210. For example, as illustrated in FIG. 3, the focal point "A" of the socket 216 at the first end 212 of the support bracket 210 may be 3.05 inches from the focal point "B" of the bore 218 at the second end 214 of the support bracket 210. Moreover, the notches 238 may be spaced 26° apart along an arc "C" the focal point of which is common to the focal point "A" of the socket 216. An adjustment between any two adjacent notches 238 in this configuration will ideally result in a one-inch incremental vertical displacement of the lateral rod 140 relative to the lateral strut 142. It is to be understood that the notches 238 and key 236 shown are for illustrative purposes and that other interlocking indexing configurations may be suitable for adjusting the height of the lateral rod 140 relative to the lateral strut 142, and vice versa. Although only three notches 238 are shown, it is to be understood that a greater or lesser number of notches 238 may be employed.

Figure 6:
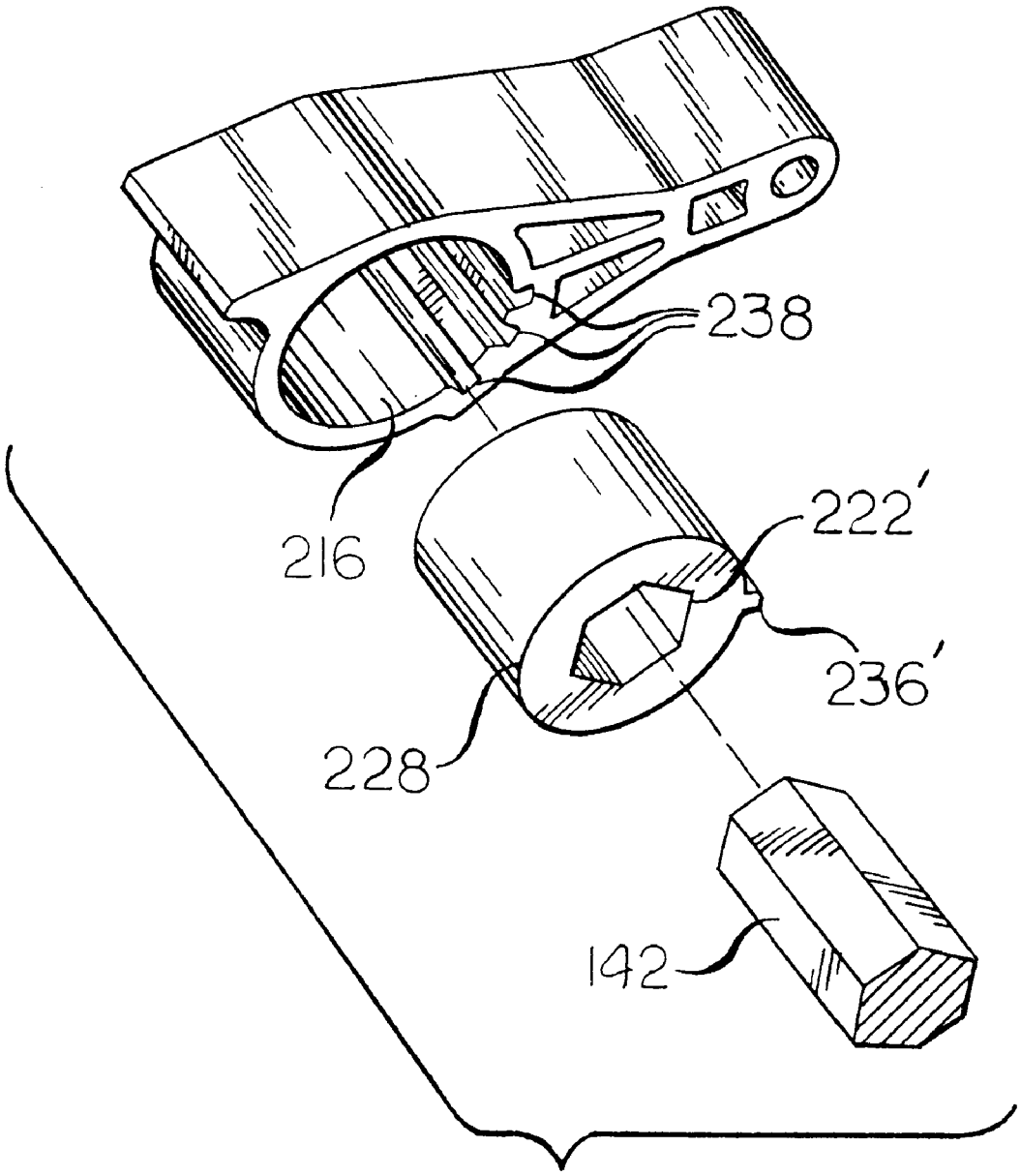
FIG. 6 is an exploded perspective view of the support bracket and a lockout clement substituted in place of a resilient element.

The support bracket 210 may be structured and configured to permit a lockout element 228 to be substituted in place of the resilient element 220. An example of a suitable lockout element 228 is shown in FIG. 6. The lockout element 228 is insertable into the socket 216. The lockout element 228 has a passage 222' for receiving the strut 142. The lockout element 228 is provided with a key 236' which is insertable into a selective one of the notches 238 to rotationally retain the lockout element 228 in a fixed position relative to the support bracket 210. The passage 222' through the lockout element 228 and the strut 142 are keyed alike to prevent the lockout element 228 from rotating relative to the strut 142. The lockout element 228 may be substituted for the resilient element 220 to rigidly couple the strut 142 and the lateral rod 140 to provide a rigid seat suspension.

The support bracket 210 may further be structured and configured to permit the resilient element 220 to be pre-loaded with a shear, or torsional, force. One configuration for pre-loading the resilient element 220 is shown in FIG. 2. This configuration includes a U-shaped member 240 comprising two laterally spaced apart legs 242 and a lateral portion 244 spanning and joining the legs 242. The lateral space between the legs 242 is dimensioned to permit the first end 212 of the support bracket 210 to be received between the legs 242. An opening 246 is provided through each leg 242. The opening 246 preferably has a shape complementary to that of the lateral strut 142 and the inner sleeve 224. A plurality of holes 248 is provided in each leg 242. Each hole 248 lies along an arc "D" the focal point of which is common with the focal point "A" of the socket 216, shown in FIG. 3. The holes 248 in one leg 242 are arranged to co-align with the holes 248 in the other leg 242.

An interference piece 250 is insertable and supported between the legs 242. A hole 251 passes laterally through the interference piece 250. The hole 251 passing through the interference piece 250 may be aligned between a selected pair of co-aligning holes 248 in the legs 242 the of the U-shaped member 240 to permit a pin 256 to be inserted into and through the hole 251 in the interference piece 250 and the co-aligning holes 248 in the legs 242 the of the U-shaped member 240. The pin 256 functions to secure the interference piece 250 between the legs 242. If desired, the interference piece 250 may be permitted to rotate slightly on the pin 256 if subject to a sufficient amount of tangential force. The pin 256 may be in the form of a threaded fastener, or any other fastener suitable for carrying out the invention.

The interference piece 250 preferably has a lateral dimension that is about equivalent to, or with in a close tolerance of, the lateral distance between the two legs 242. The lateral sides of the support bracket 210 are preferably substantially parallel relative to one another. Hence, the two legs 242 are substantially parallel relative to one another. Likewise, the ends 254 of the interference piece 250 should be substantially parallel relative to one another. The parallel relationship between the two legs 242 and the lateral sides of the support bracket 210 permits the two legs 242 to fit closely against the lateral sides of the support bracket 210. The close fit relationship between the two legs 242 and the support bracket 210 forms a trap which confines the resilient element 220 in the socket 216. The parallel relationship between the two legs 242 and the interference piece 250 permits the interference piece 250 to fit snugly between the two legs 242 without any substantial lateral slop, or binding.

The interference piece 250 is engageable with an interference member 258. The interference member 258 extends from the first end 212 of the support bracket 210. An underside of the interference member 258 preferably has a surface that is complementary in shape to that of the interference piece 250. Since the interference piece 250 shown is cylindrical in shape, the complementary surface 260 is concave and the concavity is dimensioned and configured to receive or engage the cylindrical surface of the interference piece 250. It is preferable that the first end 212 of the support bracket 210 has an outer cylindrical surface 262 extending between the interference member 258 and the bottom of the support bracket 210. It is also preferable that clearance be provided between the outer cylindrical surface 262 and the interference piece 250, and further between the interference piece 250 and the lateral portion 244 of the U-shaped member 240.

Figure 7:
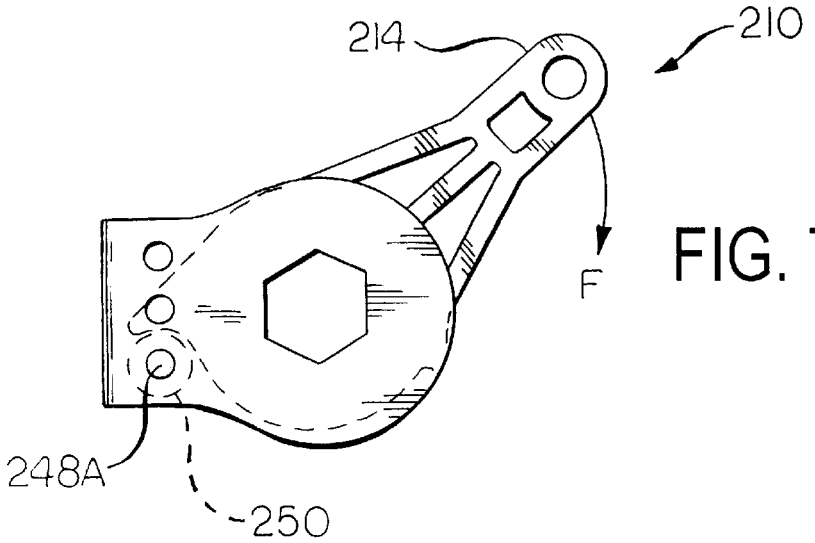
FIGS. 7 through 9 are diagrammatic representations in elevation of the support bracket pre-loaded with various torsional forces.

It should be understood from the drawings that the interference piece 250 and the interference member 258 are cooperatively engageable to resist torsional movement between the interference member 258 and the interference piece 250 in the direction of the arrow "E" (shown in FIG. 2). This resistance to torsional movement is translated between the outer sleeve 226 and the inner sleeve 224 and, in turn, the lateral strut 142. This resistance to torsional movement permits the resilient element 220 to be pre-loaded with torsional or shear forces. For example, when the interference piece 250 is not employed, the interference piece 250 is not pre-loaded with a torsional force. When the interference piece 250 is supported by the lowest pair of holes 248A, as shown in FIG. 7, the resilient element 220 is preloaded with minimum torsional force. This pre-load is provided by applying leverage against the second end 214 of the support bracket 210 to urge the second end 214 of the support bracket 210 downward in the direction of the arrow "F." This leverage is translated to the resilient element 220 in the form a shear force.

Figure 8:
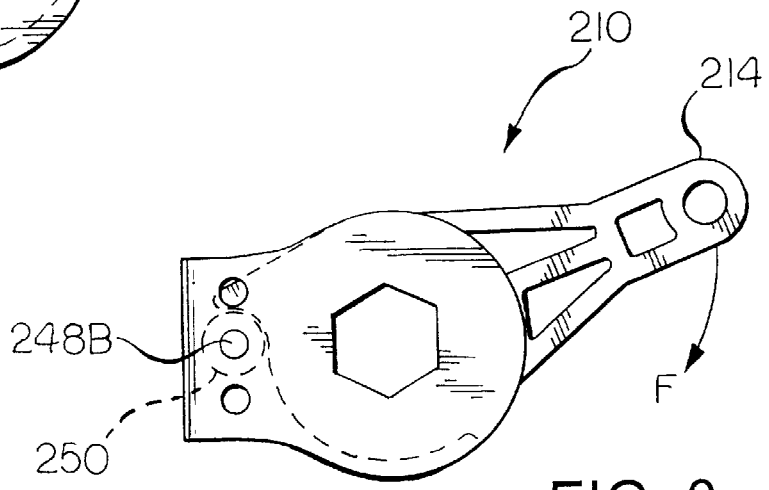

To support the interference piece 250 by the intermediate pair of holes 248B, as shown in FIG. 8, additional leverage must be applied against the second end 214 of the support bracket 210 to urge the second end 214 of the support bracket 210 downward in the direction of the arrow "F." This additional leverage is translated to the resilient element 220 as a greater shear force than that applied to the resilient element 220 as shown in FIG. 7.

Figure 9:
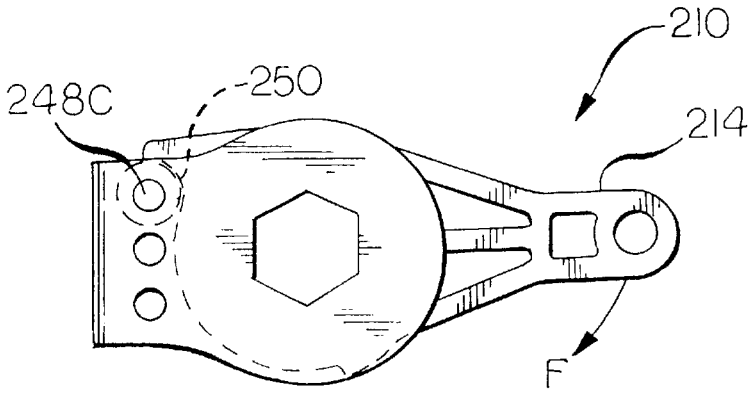

An even greater shear force may be applied to the resilient element 220 by applying additional leverage to the second end 214 of the support bracket 210 to urge the second end 214 of the support bracket 210 further downward in the direction of the arrow "F" to permit the interference piece 250 to be supported by the upper pair of holes 248C, as shown in FIG. 9. Although only three holes 248 are shown, it should be understood that a greater or lesser number of holes 248 may be provided. It should also be understood that the pre-load configuration shown and described is illustrative of a manner in which the resilient element 220 may be pre-loaded and that other pre-load configurations are conceivable and fall within the scope of the invention.

In operation, the first end 212 is coupled to the lateral strut 142. This is accomplished by inserting the lateral strut 142 into and through the first end 212 of the support bracket 210. That is, the lateral strut 142 is inserted through the opening 246 in the U-shaped member 240 and likewise, through the inner sleeve 224, or, in the absence of an inner sleeve 224, the passage 222 in the resilient element 220 supported by the socket 216 in the first end 212 of the support bracket 210. As stated above, the lateral strut 142 is supported by, and spans, the side frames 116 of the wheelchair 110. Hence, the lateral strut 142 is fixed relative to the side frame 116. The lateral rod 140 is coupled to the seat frame 114. The support bracket 210 couples the lateral strut 142 to the lateral rod 140. The elevation of the second end 214 of the support bracket 210 may be adjusted, as described above with reference to FIGS. 3 through 5. Moreover, the resilient element 220 may be pre-loaded with a shear force, as described above with reference to FIGS. 7 through 9. Pre-loading the resilient element 220 with a shear force dampens shock encounter by the wheelchair when traversing rough terrain or obstacles, and permits the support bracket 210 to be adjusted to suit wheelchair occupants of various weight and size. For example, the resilient element 220 may be pre-loaded with a greater torsional force to accommodate a heavier wheelchair occupant. For lighter wheelchair occupants, it may not be desirable to pre-load the resilient element 220.

Adjusting the elevation of the lateral rod 140 relative to the lateral strut 142 varies the inclination of the wheelchair seat frame 144. Varying the inclination of the wheelchair seat frame 144 repositions, or shifts the weight of, the wheelchair occupant, which reduces trauma to the skin around the pelvis region caused by a constant application pressure to particular points of the skin tissue. The adjustment configuration also permits the wheelchair occupant to be shifted in accordance with various activities that the wheelchair occupant encounters. Moreover, the adjustment configuration permits the wheelchair occupant's center of gravity to be adjusted. Furthermore, the adjustment configuration permits the disposition of the support bracket 210 as a result of pre-loading to be offset. The support bracket 210 provides greater comfort and stability for the wheelchair occupant.

It may be cost effective to mold or extrude the support bracket 210 to produce a molded or extruded support bracket 210 such as that shown throughout the drawings. Although a molded or extruded support bracket 210 is shown, it should be understood that the support bracket 210 may be formed or fabricated in other manners.

The support bracket 210 is simpler in construction than a conventional shock absorber. The support bracket 210 employs fewer parts than a conventional shock absorber, and hence, is more cost-effective to produce than a conventional shock absorber. The support bracket 210 is lighter than a conventional shock absorber. It eliminates the mechanical movement associated with conventional shock absorbers. The support bracket 210 is self-dampening, and hence, requires no fluid reservoir, as is required by conventional oil-filled shock absorbers.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A support bracket for supporting a wheelchair frame relative to a wheelchair base frame, the base frame comprising spaced-apart side frames joined together by struts, the side frames having coupled thereto a lateral strut, the seat frame having coupled thereto a lateral rod, said support bracket comprising:

a first end and a socket provided in said first end;

a second end, said second end being structured and configured to couple to the lateral rod;

a resilient element having a passage provided therein, said socket being dimensioned and configured to receive said element, said passage being dimensioned and configured to receive the lateral strut, said element being positionable in a substantially fixed position relative to the lateral strut;

an inner sleeve; and an outer sleeve, said resilient element being between said inner sleeve and said outer sleeve, said resilient element being substantially fixed relative to said inner sleeve and said outer sleeve.

2. The support bracket according to claim 1, wherein said resilient element is an elastomeric material.

3. The support bracket according to claim 1, wherein said inner sleeve has a shape corresponding to that of the lateral strut to prevent the lateral strut from rotating relative to said inner sleeve.

4. The support bracket according to claim 1, wherein said outer sleeve is provided with a key; and said socket is provided with a notch, said notch is dimensioned and configured to receive said key, and said key is insertable into said notch to adjust the elevation of said second end of said support bracket.

5. The support bracket according to claim 1, wherein said outer sleeve is provided with a key; and said socket is provided with a plurality of notches, each said notch is dimensioned and configured to receive said key, said notches are circumferentially spaced apart and said key is selectively insertable into said notches to adjust the elevation of said second end of said support bracket.

6. The support bracket according to claim 1, further including:

spaced apart tabs each having co-aligning holes therein, wherein said spaced apart tabs are adapted to extend from the lateral rod; and a bore is provided in said second end, said bore in said second end of said support bracket and the co-aligning holes in the tabs being alignable to permit a pin to be inserted through the co-aligning holes and said bore.

7. The support bracket according to claim 6, further including:

a sleeve insertable into said bore in said second end of said support bracket and carried by said pin.

8. The support bracket according to claim 6, wherein said sleeve is provided with a flange.

9. The support bracket according to claim 1, wherein said support bracket is structured and configured to permit said resilient element to be pre-loaded with a torsional force.

10. The support bracket according to claim 1, further including:

a U-shaped member comprising two spaced apart legs and a portion spanning and joining said legs, said legs being spaced apart to receive said first end of said support bracket, each said leg being provided with an opening configured to permit the passage of the lateral strut therethrough.

11. The support bracket according to claim 10, further including:

an interference piece, said U-shape member being structured and configured to support said interference piece between said legs; and an interference member extending from said first end of said support bracket, said interference piece being engageable with said interference member upon preloading said resilient element with a torsional force.

12. The support bracket according to claim 11, wherein said interference piece is selectively adjustable relative to said U-shaped member to adjust the pre-loaded torsional force.

13. The support bracket according to claim 10, further including a hole in each said leg, said hole in one said leg being arranged to co-align with said hole in the other said leg;

an interference piece insertable between said legs, said interference piece having a hole passing therethrough which may be aligned between said co-aligning holes in said legs to permit a pin to be inserted into and through said hole in the interference piece and said co-aligning holes in said legs to secure said interference piece between said legs and;

an interference member extending from said first end of said support bracket, said interference piece being engageable with said interference member.

14. A support bracket for supporting a wheelchair seat frame relative to a wheelchair base frame, the base frame comprising spaced-apart side frames, the side frames having coupled therebetween a lateral strut, the seat frame having coupled thereto a lateral rod, said support bracket comprising:

a first end and a socket provided in said first end, said socket being provided with a notch;

a second end, said second end being structured and configured to couple to the lateral rod;

a resilient element;

an inner sleeve; and an outer sleeve, said resilient element being between said inner sleeve and said outer sleeve, said resilient element being substantially fixed relative to said inner sleeve and said outer sleeve, said socket being is dimensioned and configured to receive said outer sleeve, said inner sleeve forming a passage, said passage being dimensioned and configured to receive said inner sleeve, the lateral strut being positionable in a substantially fixed position relative to the lateral strut, said outer sleeve being provided with a key, said notch being dimensioned and configured to receive said key, said key being insertable into said notch to adjust the elevation of said second end of said support bracket.

15. A support bracket for supporting a wheelchair frame relative to a wheelchair base frame, the base frame comprising spaced-apart side frames, the side frames having coupled therebetween a lateral strut, the seat frame having coupled thereto a lateral rod, said support bracket comprising:

a first end and a socket provided in said first end;

a second end, said second end being structured and configured to couple to the lateral rod;

a resilient element having a passage provided therein, said socket being dimensioned and configured to receive said resilient element, said passage being dimensioned and configured to receive the lateral strut, said resilient element being positionable in a substantially fixed position relative to the lateral strut;

a U-shaped member comprising two spaced apart legs and a portion spanning and joining said legs, said legs being spaced apart to receive said first end of said support bracket, each said leg being provided with an opening therein configured to permit the passage of the lateral strut therethrough;

an interference piece, said U-shaped member being structured and configured to support said interference piece between said legs; and an interference member extending from said first end of said support bracket, said interference piece being engageable with said interference member.

16. The support bracket according to claim 15, further comprising:

an inner sleeve; and an outer sleeve, said resilient element being between said inner sleeve and said outer sleeve, said resilient element being substantially fixed relative to said inner sleeve and said outer sleeve.

17. A wheelchair comprising:

a wheelchair base frame, said base frame comprising spaced-apart side frames joined together by a strut, said side frames having coupled thereto a lateral strut; a wheelchair seat frame, said seat frame having coupled thereto a lateral rod;

a support bracket for supporting said wheelchair seat frame relative to said wheelchair base frame, said support bracket comprising:

a first end and a socket provided in said first end;

a second end, said second end being structured and configured to couple to said lateral rod;

a resilient element having a passage provided therein, said socket being dimensioned and configured to receive said resilient element, said passage being dimensioned and configured to receive said lateral strut, said lateral strut being positionable in a substantially fixed position relative to said resilient element;

and inner sleeve; and an outer sleeve, said resilient element being between said inner sleeve and said outer sleeve, said resilient element-being substantially fixed relative to said inner sleeve and said outer sleeve.

18. A wheelchair comprising:

a wheelchair base frame, said base frame comprising spaced-apart side frames, said side frames having dopuled thereto a lateral strut;

a wheelchair seat frame, said seat frame having coupled thereto a lateral rod;

a supprot bracket for supporting said wheelchair seat frame relative to said wheelchair base frame, said support bracket comprising:

a first end and a socket provided in said first end; and a second end, said second end coupled to said lateral rod; and a resilient element having a passage provided therein, said socket receiving said resilient element, said passage receiving said lateral strut, said lateral strut being positionable in a substantilly fixed position relative to said resilient element.

* * * * *